US012196194B2

(12) United States Patent
Chang

(10) Patent No.: US 12,196,194 B2
(45) Date of Patent: Jan. 14, 2025

(54) MINIATURE PUMP

(71) Applicant: Ziyu Enterprise Co., Ltd., Taichung (TW)

(72) Inventor: Chi-Yuan Chang, Taichung (TW)

(73) Assignee: Ziyu Enterprise Co., Ltd., Taichung (TW)

( * ) Notice: Subject to any disclaimer, the term of this patent is extended or adjusted under 35 U.S.C. 154(b) by 71 days.

(21) Appl. No.: 18/346,947

(22) Filed: Jul. 5, 2023

(65) Prior Publication Data

US 2024/0418159 A1 Dec. 19, 2024

(30) Foreign Application Priority Data

Jun. 16, 2023 (TW) ..... 112122664

(51) Int. Cl.

| | |
|---|---|
| ***F04B 33/00*** | (2006.01) |
| ***F04B 45/02*** | (2006.01) |
| ***F04B 53/10*** | (2006.01) |
| ***F04B 53/16*** | (2006.01) |

(52) U.S. Cl.

CPC ..... *F04B 45/02* (2013.01); *F04B 53/10* (2013.01); *F04B 53/16* (2013.01)

(58) Field of Classification Search

CPC . A43B 21/285; A43B 17/035; F04B 43/0063; F04B 45/00; F04B 45/02; F04B 33/00

See application file for complete search history.

(56) References Cited

U.S. PATENT DOCUMENTS

| | | | | |
|---|---|---|---|---|
| 5,846,063 | A * | 12/1998 | Lakic | B62J 1/26 36/43 |
| 7,546,696 | B1 * | 6/2009 | Acheson | A43B 23/029 36/35 B |
| 7,950,909 | B2 * | 5/2011 | Chang | F04B 45/02 417/480 |
| 10,900,479 | B2 * | 1/2021 | Hsu | F04B 45/04 |
| 2015/0300512 | A1 * | 10/2015 | Chen | F04B 33/00 137/223 |
| 2020/0217312 | A1 * | 7/2020 | Chang | F04B 49/03 |
| 2024/0240724 | A1 * | 7/2024 | Chen | F04B 45/02 |

FOREIGN PATENT DOCUMENTS

| | | | | |
|---|---|---|---|---|
| FR | 3061420 | A1 * | 7/2018 | A42B 1/22 |
| GB | 2560701 | A * | 9/2018 | A42B 1/22 |
| KR | 200192285 | Y1 * | 3/2000 | |
| WO | WO-9400032 | A1 * | 1/1994 | A41D 19/001 |

* cited by examiner

*Primary Examiner* — Thomas Fink

(74) *Attorney, Agent, or Firm* — Best & Flanagan LLP

(57) ABSTRACT

A miniature pump includes an upper shell, an air bag and a lower shell. The air bag is formed on the upper shell. The lower shell is connected to the upper shell in an air-tight manner. The air bag is compressible to pump air from it and expansible to suck air into it. The lower shell includes two grids for reinforcement so that the lower shell is not deformed when the air bag is compressed on the lower shell.

10 Claims, 11 Drawing Sheets

MINIATURE PUMP

BACKGROUND OF INVENTION

1. Field of Invention

The present invention relates to a pump and, more particularly, to a miniature pump operable with a finger.

2. Related Prior Art

A conventional miniature pump is attached to an inflatable portion of a product such as an inflatable sole of a sneaker. It is a waste since the miniature pump is only useful for pumping the inflatable portion of the product only.

In operation, a user contacts a button of the miniature pump with a finger such as the thumb and contacts a bottom of the miniature pump with other fingers. The bottom of the miniature pump, which is often flexible, is often deformed so that a channel of air in the miniature pump is squeezed. Thus, the inflation is hindered.

The present invention is therefore intended to obviate or at least alleviate the problems encountered in the prior art.

SUMMARY OF INVENTION

It is the primary objective of the present invention to provide a reliable miniature pump.

To achieve the foregoing objective, the miniature pump includes an upper shell, an air bag, a lower shell, a partition, a check valve, a distributor valve and a switch. The air bag is located in the upper shell. The lower shell is connected to the upper shell in an air-tight manner. The lower shell includes a chamber, two grids, a bore and a channel. The chamber is located corresponding to the air bag. The grids extend from a floor of the chamber. The bore is in a portion of the chamber not covered by the first and second grids. The bore is in communication with exterior of the lower shell through the channel. The partition is located between the upper and lower shells. The partition closes an opening of the air bag. The partition is separated from the first and second grids, thereby providing a gap between the partition and the grids. The partition includes a cutout corresponding to the second grid and a pothole corresponding to the air bag. The check valve is located above the pothole. The check valve includes a passageway, an inlet at an end of the passageway, an outlet at another end of the passageway. The inlet is in communication with the air bag. The outlet is aligned to the cutout. The distributor valve is located in the lower shell. The distributor valve includes cylinder, a conduit in communication with the cylinder and located in the channel, a first distributor pipe in communication with the cylinder, and a second distributor pipe in communication with cylinder. The switch includes an axle pivotably located in the cylinder and distribution apertures in communication with a space in the axle. One of the distribution apertures is in communication with the conduit and another one of the distribution apertures is selectively in communication with the first or second distributor pipes while the remaining ones of the distribution apertures are closed by the cylinder.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
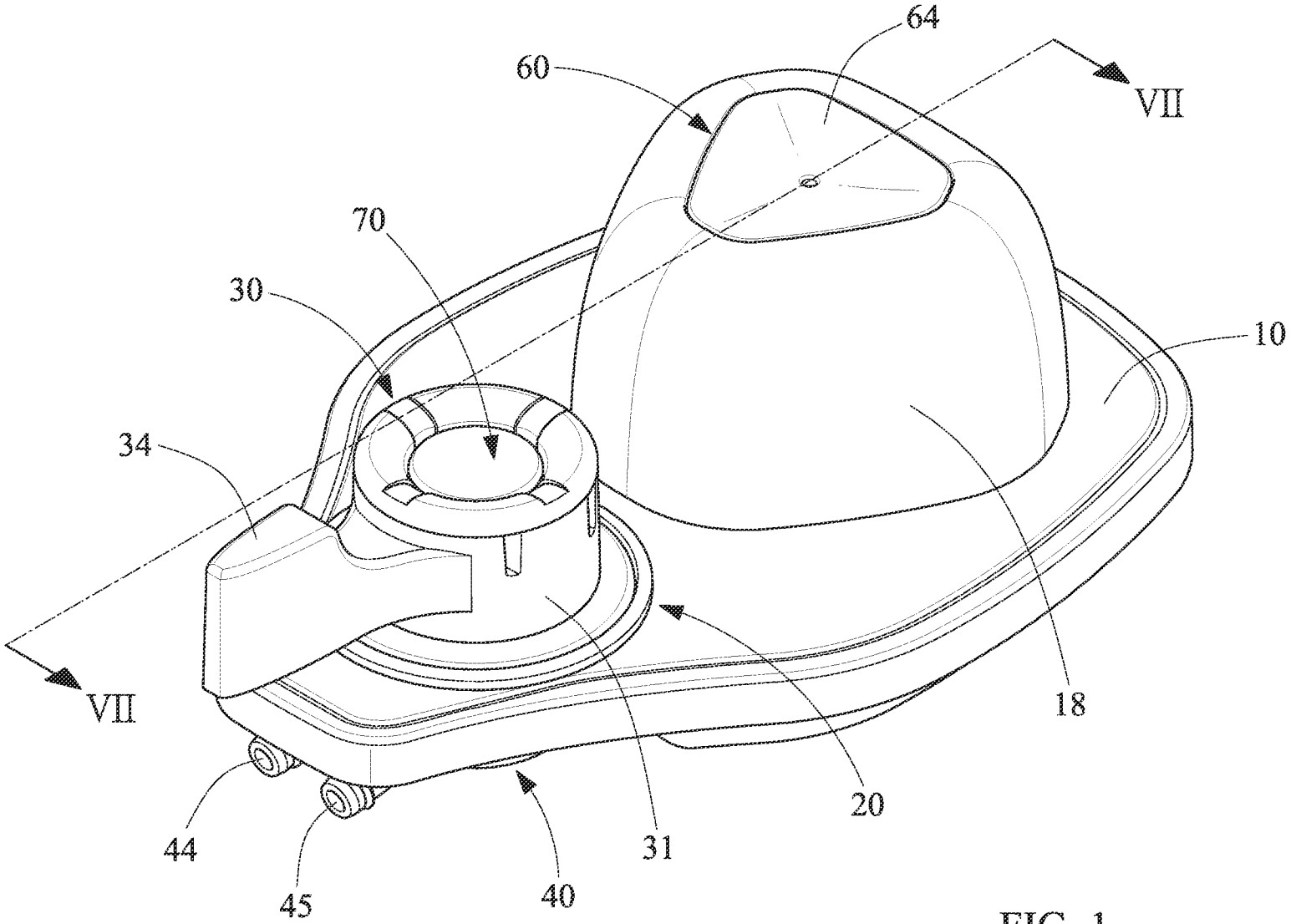
FIG. 1 is a perspective view of a miniature pump according to the preferred embodiment of the present invention.
Figure 2:
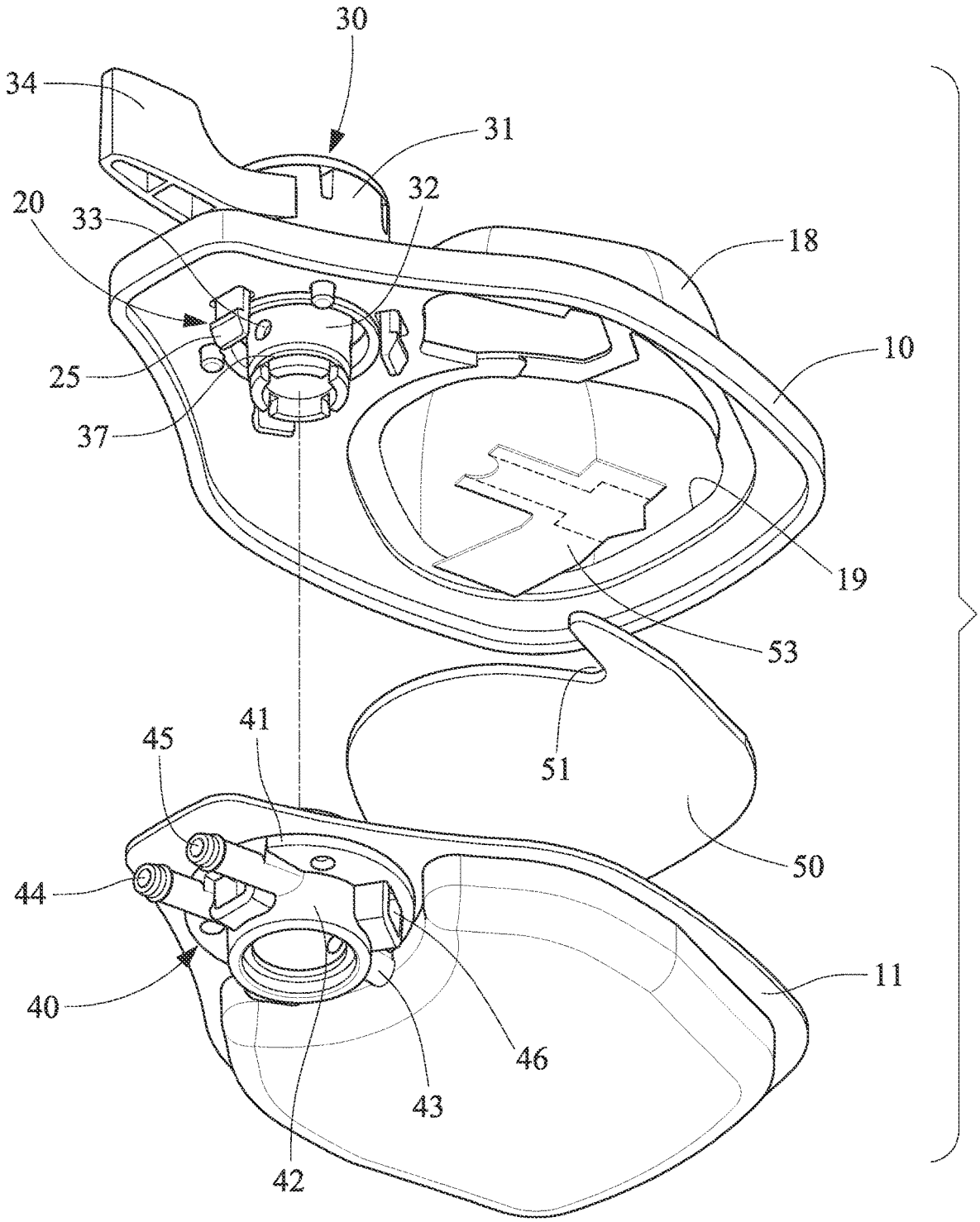
FIG. 2 is an exploded view of the miniature pump shown in FIG. 1.
Figure 3:
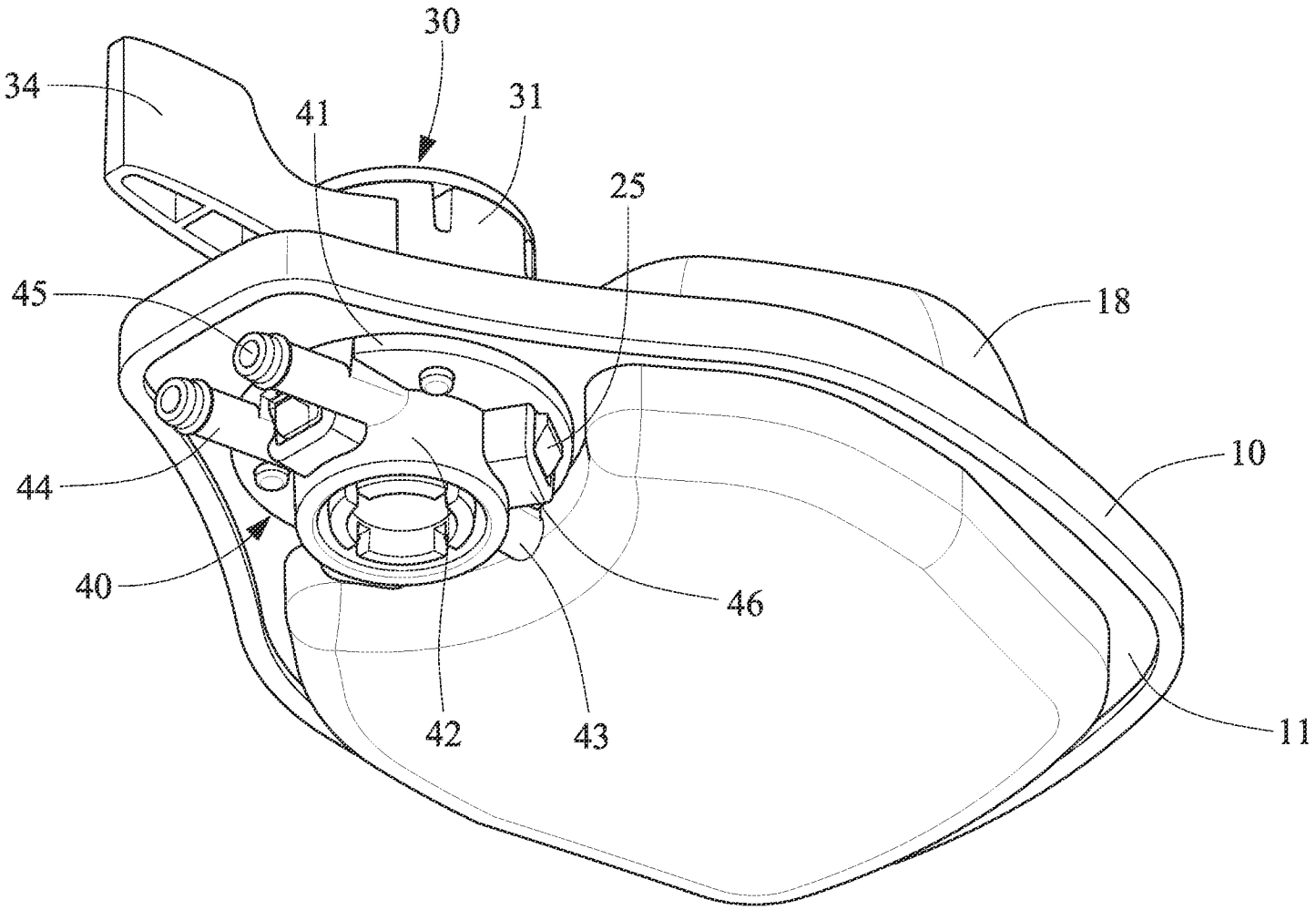
FIG. 3 is a perspective view of the miniature pump shown in FIG. 2.
Figure 4:
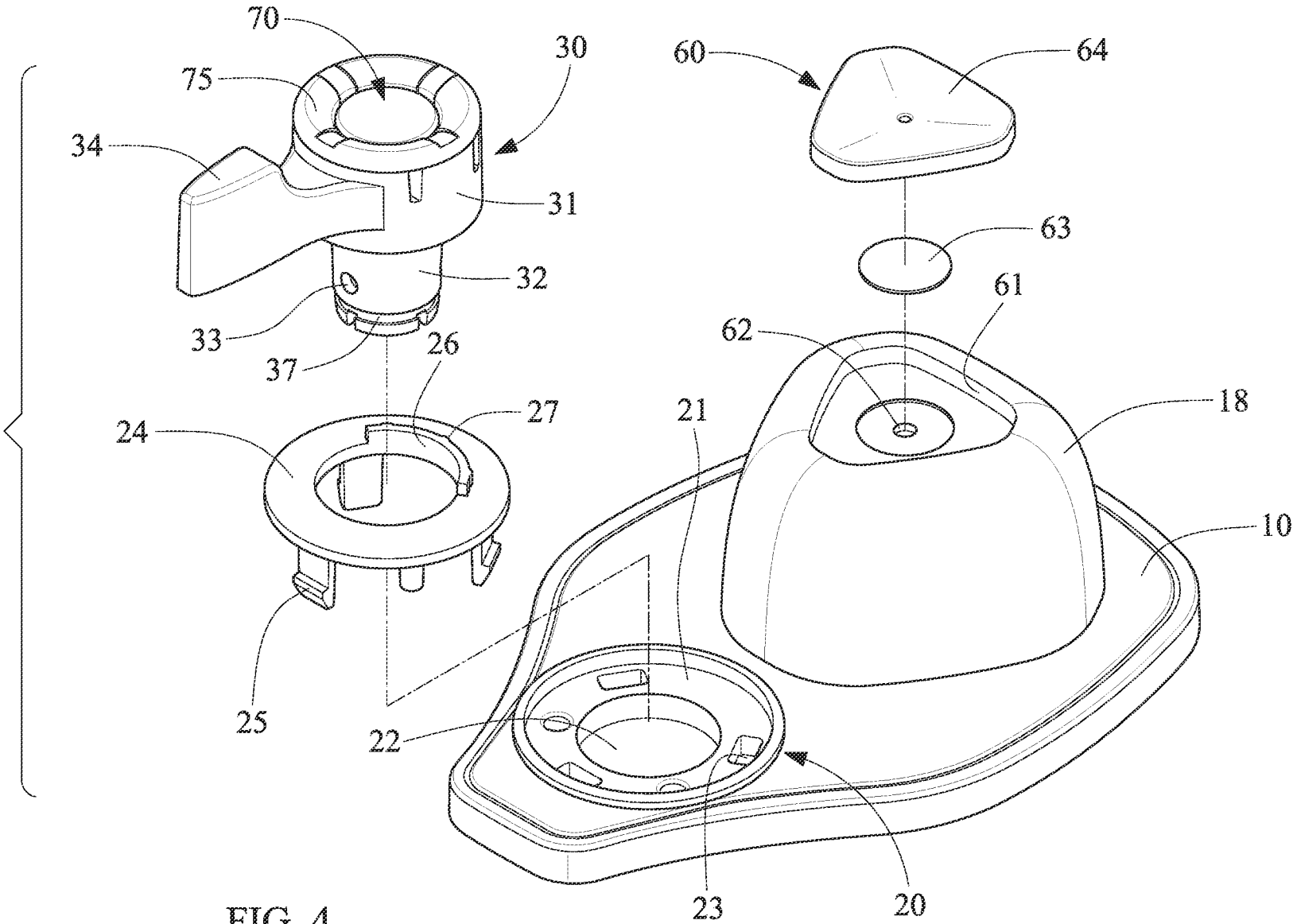
FIG. 4 is an exploded view of an upper portion of the miniature pump shown in FIG. 2.

Referring to FIGS. 1 through 3, miniature pump includes upper shell 10, a lower shell 11, an air bag 18, a switch 30, a distributor valve 40 and a partition 50 according to the preferred embodiment of the present invention. The periphery of the upper shell 10 is connected to the periphery of the lower shell 11 in an air-tight manner. The air bag 18 and the switch 30 are connected to the upper shell 10. The distributor valve 40 is connected to the lower shell 11. The distributor valve 40 is connected to the switch 30. The partition 50 is located between the upper shell 10 and the lower shell 11. The partition 50 includes a check valve 53 in the form of a flip. The check valve 53 allows air to go to the distributor valve 40 from the air bag 18, but not vice versa, Referring to FIG. 4, the upper shell 10, the air bag 18 and the switch 30 will be described. The air bag 18 is a portion of the upper shell 10. The air bag 18 is compressible to send air from it and expansible to suck air in it. The air bag 18 is provided with a check valve 60. When expanding, the air bag 18 sucks air into it through the check valve 60. An upper face of the air bag 18 is made with a recess 61 and an inlet aperture 62. The inlet aperture 62 is located in the recess 61. The check valve 60 includes a membrane 63 and a button 64. The membrane 63 is located over the inlet aperture 62 in the recess 61. The button 64 is located in the recess 61. The periphery of the button 64 is shaped like the periphery of the recess 61.

A connector 20 is located in the upper shell 10. An upper face of the connector 20 is formed with an annular recess 21, an orifice 22 and bores 23. The annular recess 21 extends around the orifice 21. The bores 23 are located in the annular recess 21. The connector 20 includes a ring 24, hooks 25 and an arched wall 26. The hooks 25 extend from a lower face of the ring 24. The hooks 25 are evenly arranged along the ring 24. The arched wall 26 extends from an upper face of the ring 24. The arched wall 26 extends in an arched manner. An external face of the arched wall 26 is formed with bosses 27.

Figure 8:
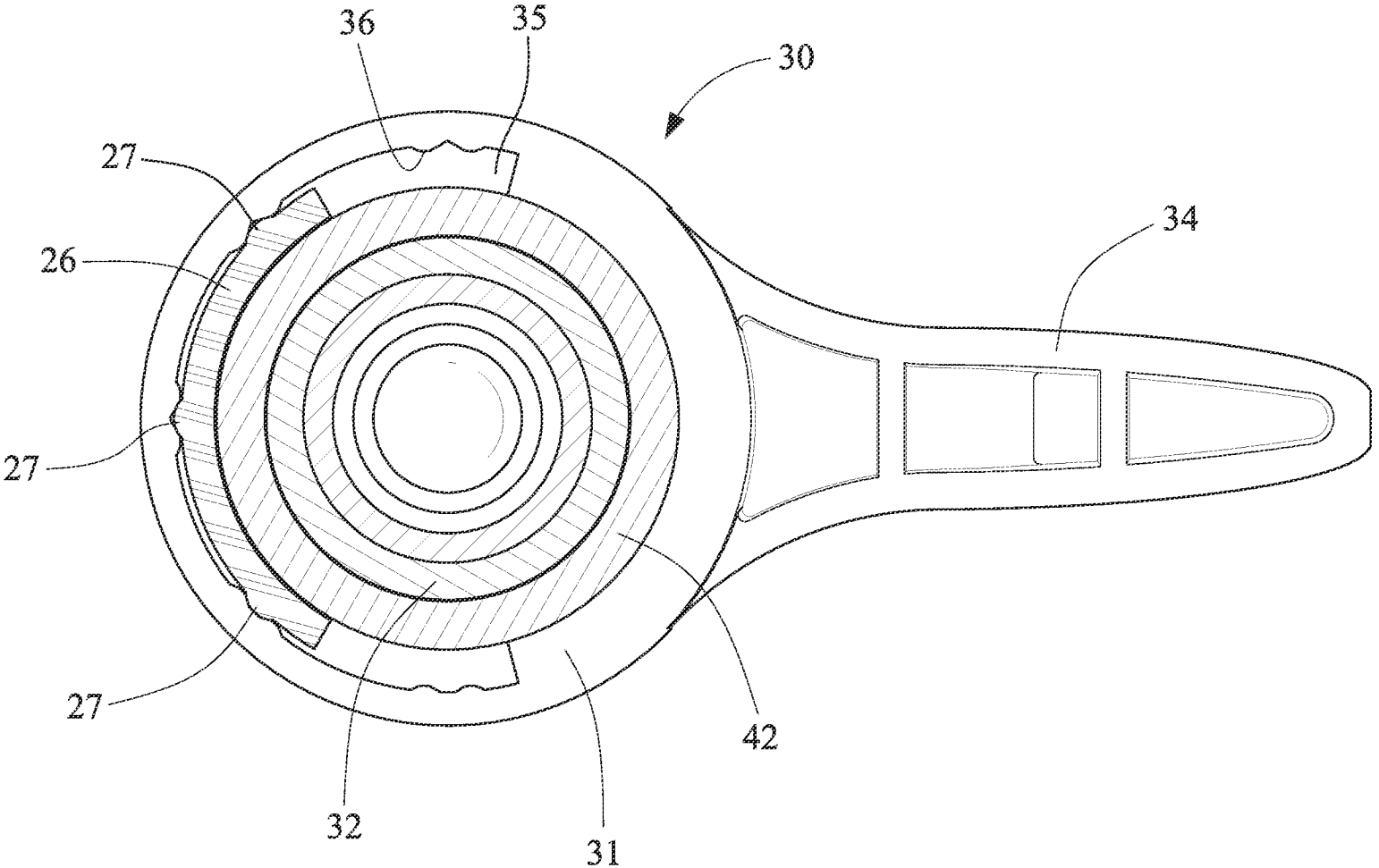
FIG. 8 is another cross-sectional view of the miniature pump shown in FIG. 1.

The switch 30 includes a knob 31, an axle 32, three distribution apertures 33, a lever 34 and an arched recess 35 (FIG. 8). The axle 32 axially extends from a lower face (or "end") of the knob 31. The distribution apertures 33 are evenly made in the periphery of the axle 32. The lever 34 extends from the periphery of the knob 31 in a radial manner. The arched recess 35 is made in a lower face (or "end") of the axle 32.

Figure 5:
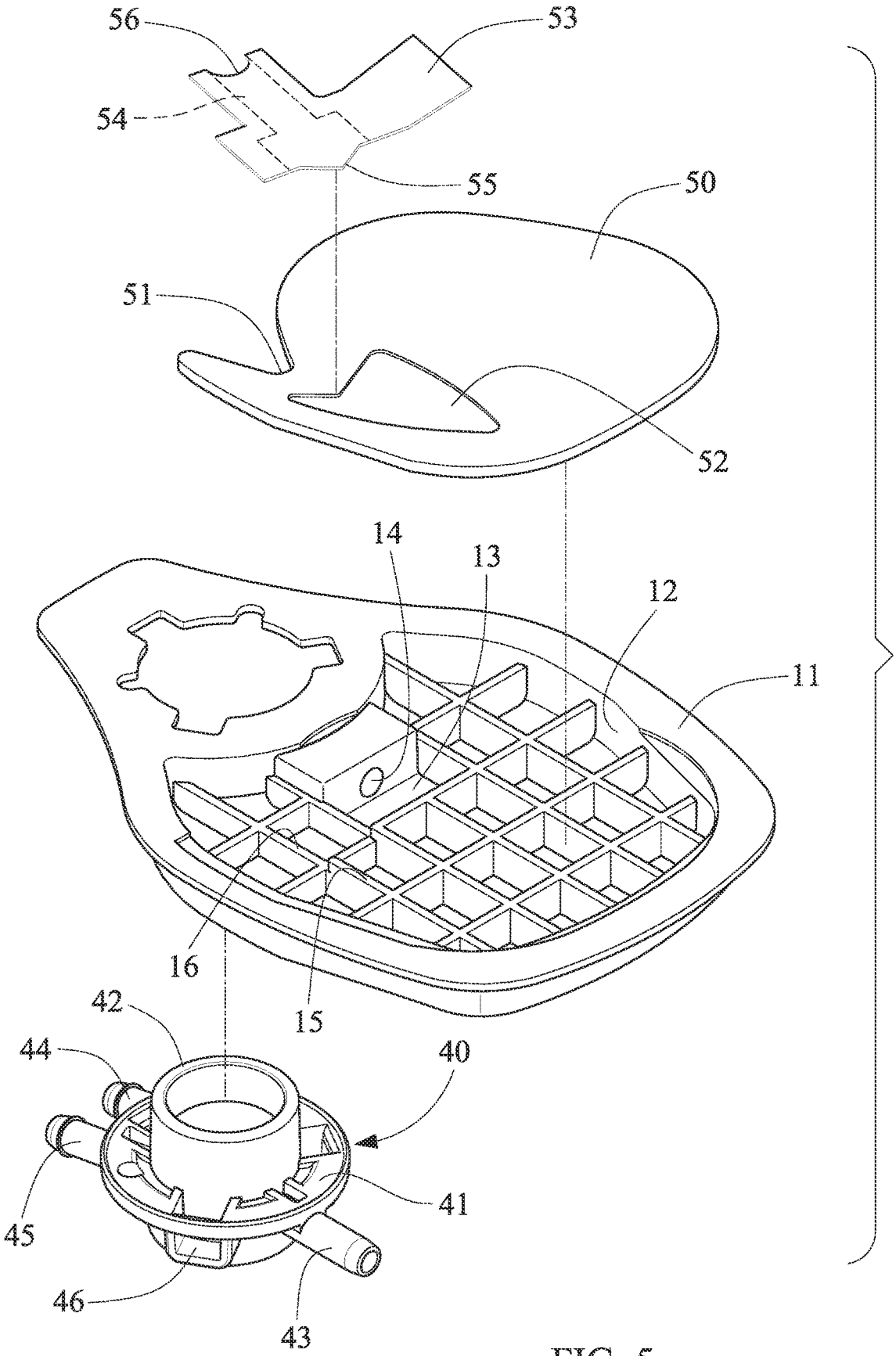
FIG. 5 is an exploded view of a lower portion of the miniature pump shown in FIG. 2.
Figure 6:
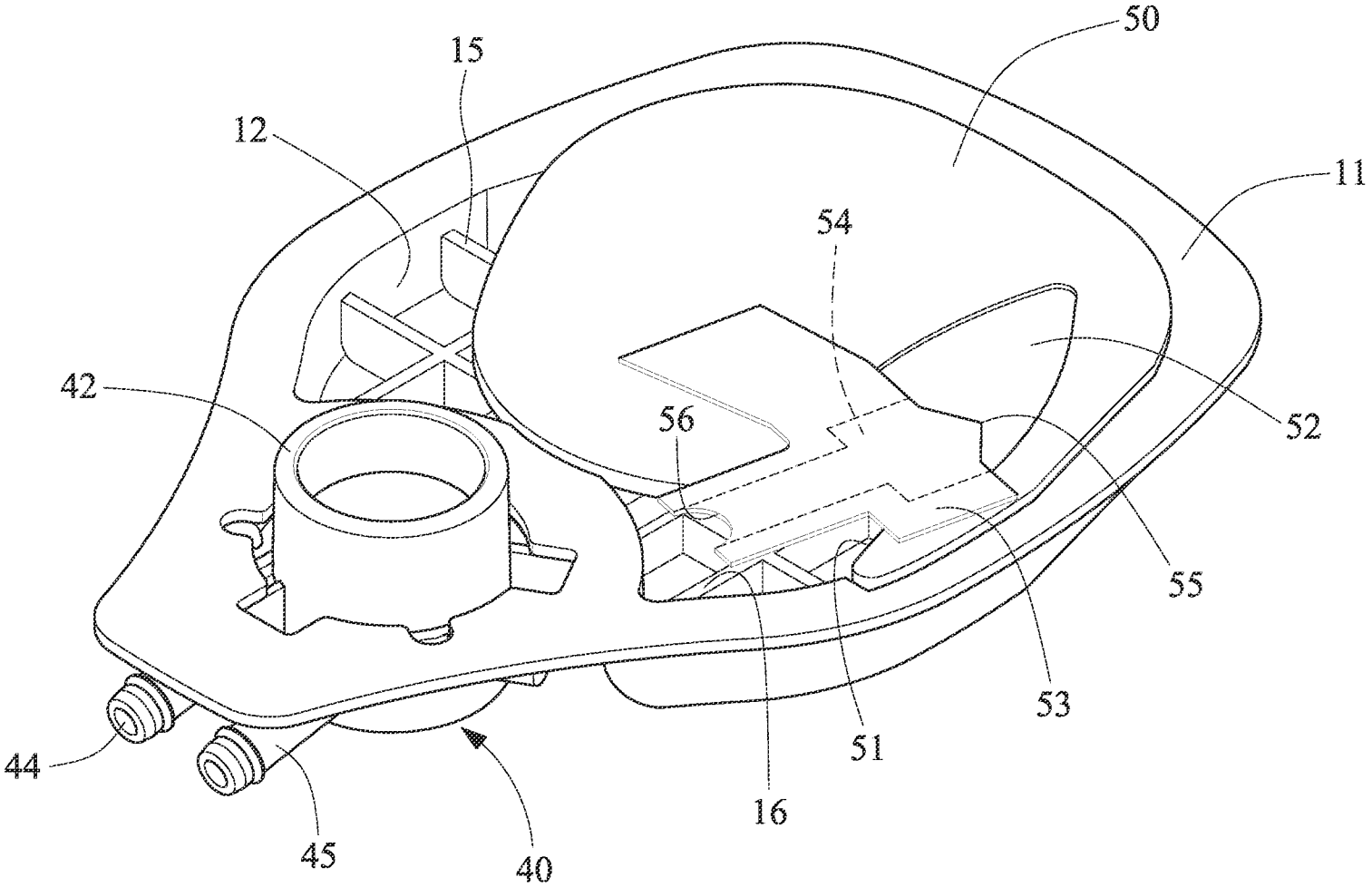
FIG. 6 is a perspective view of the lower portion of the miniature pump shown in FIG. 5.

Referring to FIGS. 5 and 6, the lower shell 11, the partition 50, the check valve 53 and the distributor valve 40 will be described. The lower shell 11 includes a chamber 12, a bore 13 and a channel 14 made in an upper face. The bore 13 is located in the chamber 12. The channel 14 is in communication with the bore 13.

Two grids 15 and 16 extend on the upper face of the lower shell 11 so that the lower shell 11 is adequately rigid. Preferably, the grid 15 extends higher than the grid 16.

Figure 7:
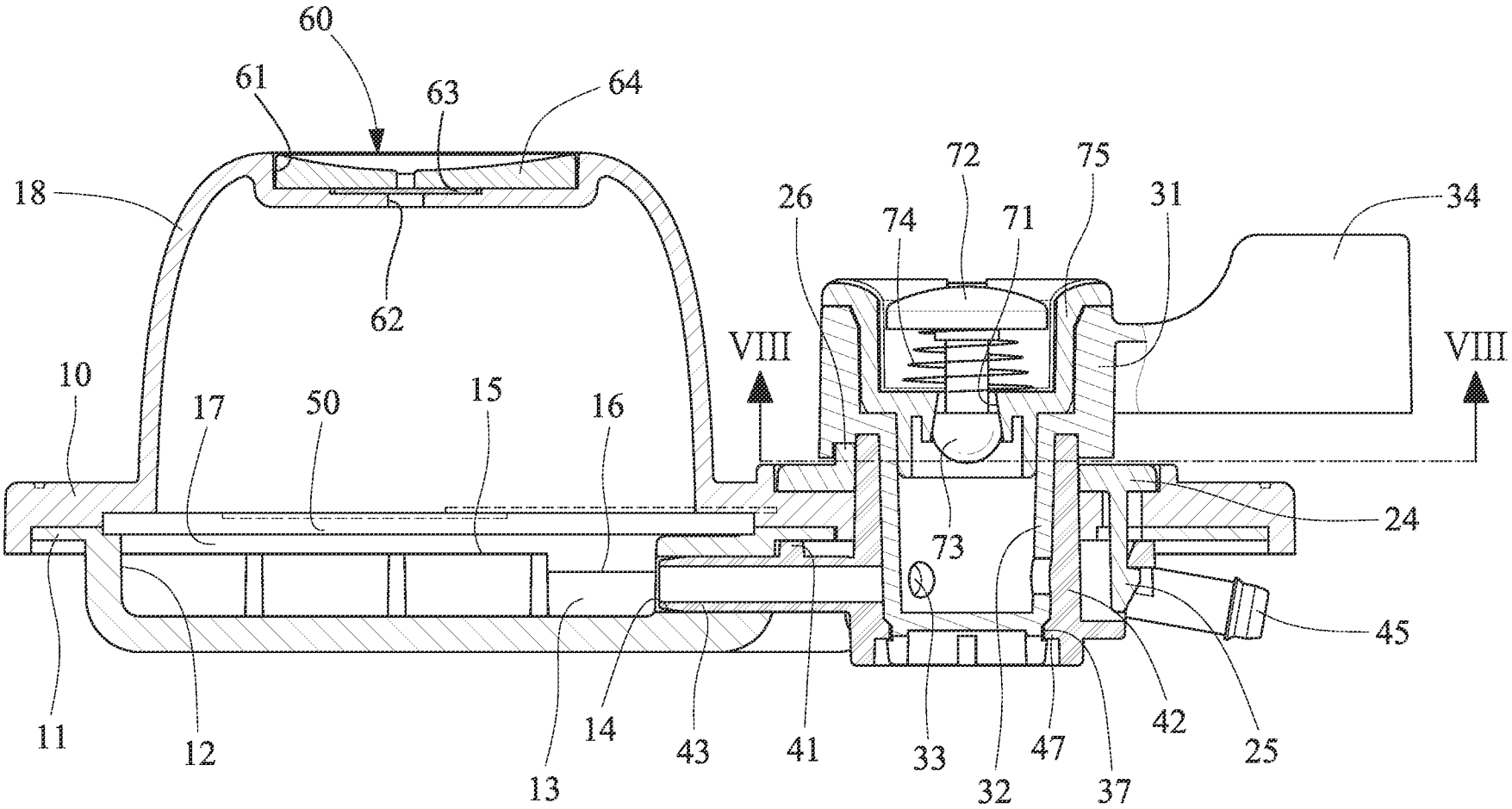
FIG. 7 is a cross-sectional view of the miniature pump shown in FIG. 1.

The partition 50 is located between the upper shell 10 and the lower shell 11. The partition 50 includes an edge made with a cutout 51 corresponding to the grid 16. The partition 50 further includes a pothole 52. The check valve 53 extends over the pothole 52. The check valve 53 is formed with a passageway 54 including an inlet 55 at an end and an outlet 56 at another end. The inlet 55 is in communication with the air bag 18 via the pothole 52. The outlet 56 is located above the cutout 51. Air goes into the passageway 54 via the inlet 55. Then, the air goes from the passageway 54 via the outlet 56. Then, the air goes into the bore 13 from the outlet 56 through a gap between the partition 50 and the grids 15 and 16 (FIG. 7). Then, the air goes into the channel 14 from the bore 13.

The distributor valve 40 includes a valve housing 41, a cylinder 42, a conduit 43, two distributor pipes 44 and 45, and several receptacles 46. The valve housing 41 extends around the cylinder 42. The conduit 43 and the distributor pipes 44 and 45 extend from the cylinder 42. Through the conduit 43 and the distributor pipes 44 and 45, the interior of the cylinder 42 is in communication with the exterior of the cylinder 42. The distributor pipes 44 and 45 can be connected to two different inflatable products (not shown) if the miniature pump is a stand-alone device. The distributor pipes 44 and 45 can be connected to two different inflatable portions of a same product (not shown) if the miniature pump is connected to the same product. The receptacle 46 are formed in a lower portion of the valve housing 41.

Referring to FIG. 7 in addition to FIGS. 1 through 3, as mentioned above, the periphery of the shell 10 is connected to the periphery of the lower shell 11 in an air-tight manner. The partition 50 is located between the upper shell 10 and the lower shell 11. The partition 50 is not in contact with the grids 15 and 16 so that the gap 17 exits between the partition 50 and the grids 15 and 16. The partition 50 covers an opening 19 of the air bag 18.

The valve housing 41 of the distributor valve 40 is connected to the lower portion of the lower shell 11. The conduit 43 is located in the channel 14 of the lower shell 11.

The ring 24 is located in the annular recess 21. The hooks 25 into the receptacles 46 of the valve housing 41 through the bores 23.

The knob 31 of the switch 30 is located on the ring 24. The arched wall 26 is located in the arched recess 35 (FIG. 8). The axle 32 is located in the cylinder 42 via the orifice 22. The cylinder 42 includes an annular rib 47 on an internal face. The axle 32 includes an annular groove 37 in an external face. The annular rib 47 is located in the annular groove 37 to retain the axle 32 of the switch 30 in the cylinder 42 of the distributor valve 40.

Referring to FIG. 8, the knob 31 is pivotable by operating the lever 34. There are bosses 27 on the arched wall 26. There are dents 36 in a wall of the arched recess 35. The amount of the dents 36 is larger than the amount of the bosses 27. The bosses 27 are insertable in some of the dents 36 to keep the switch 30 in a position R referring to FIG. 10, a position M shown in FIG. 9 or a position L referring to FIG. 11. The bosses 27 are moved from the dents 36 when the knob 31 is pivoted.

Figure 10:
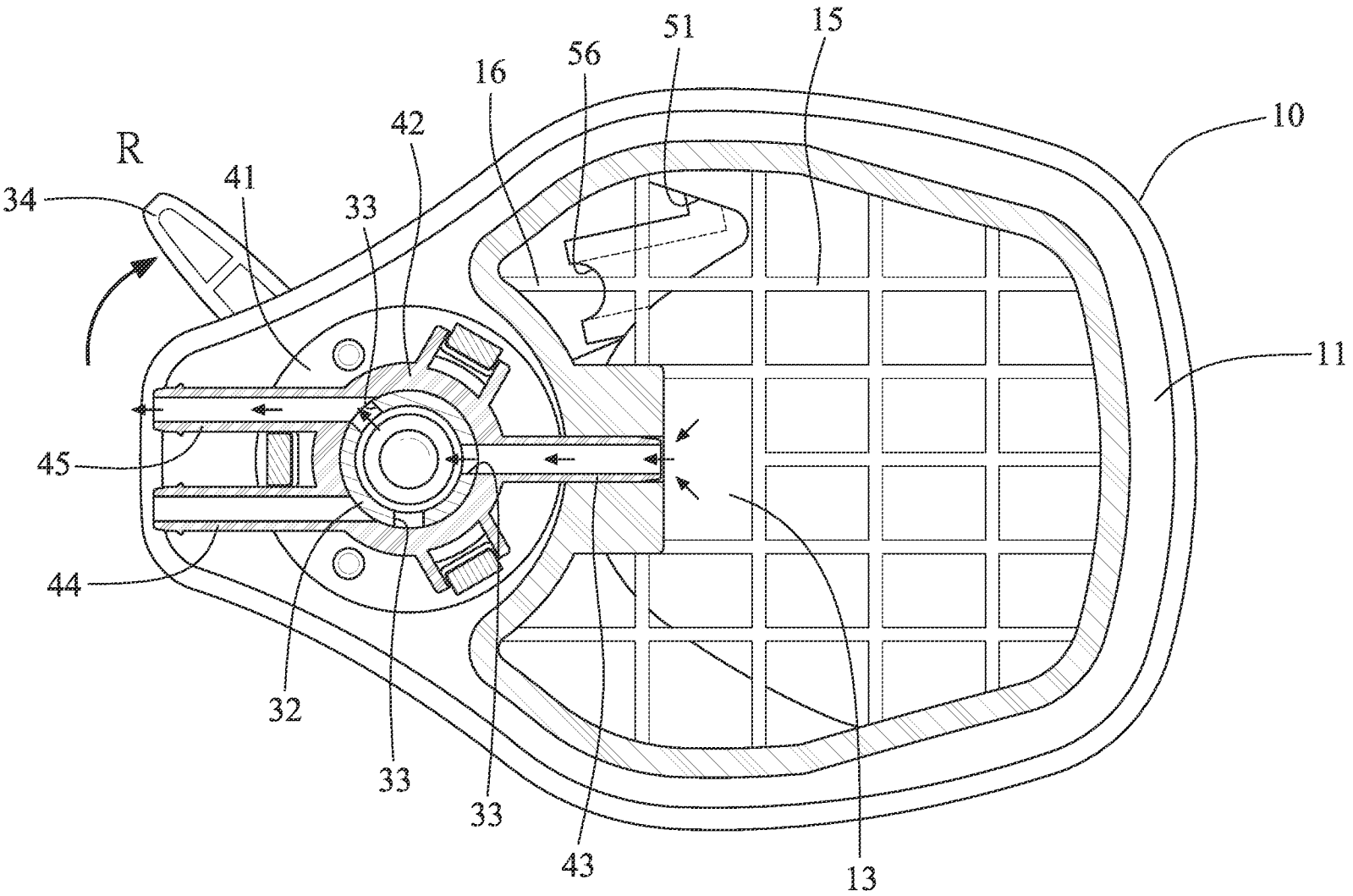
FIG. 10 is a cross-sectional view of the miniature pump in another position than shown in FIG. 9.
Figure 11:
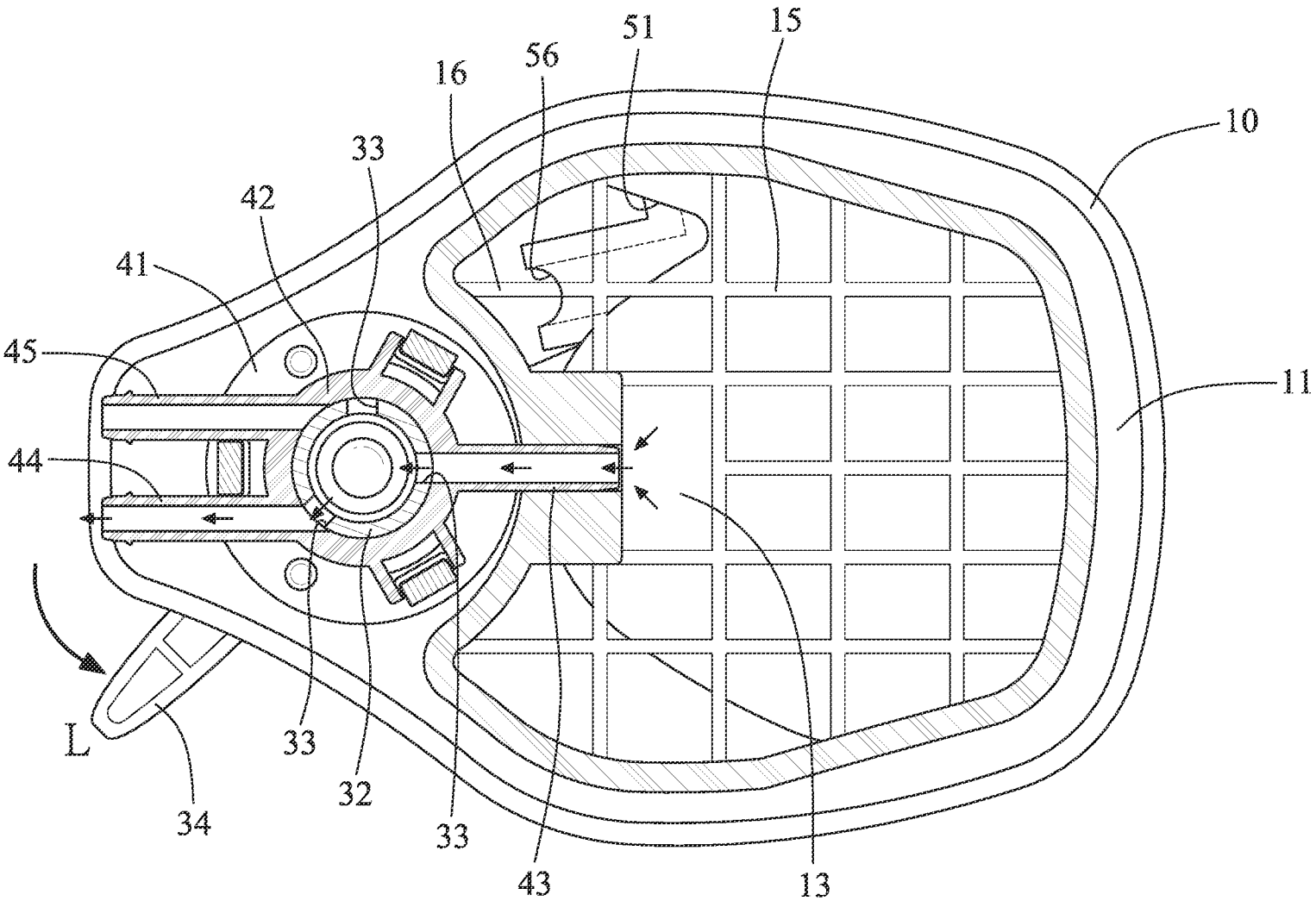
FIG. 11 is a cross-sectional view of the miniature pump in another position than shown in FIG. 10.

Referring to FIGS. 7, 10 and 11, the operation of the miniature pump will be described. The button 64 is released to allow the air bag 18 to expand to suck air into the air bag 18.

The button 64 is pushed to compress the air bag 18. The grids 15 and 16 render the lower shell 11 too rigid to be deformed. Thus, travel of the air through the gap 17, the bore 13 and the conduit 43 remains smooth.

As the air bag 18 is compressed, the air goes into the check valve 53 into the passageway 54 via the inlet 55. The air goes from the passageway 54 through the outlet 56. The air goes into the conduit 43 from the gap 17 through the bore 13.

Referring to FIG. 10, the switch 30 is in the position R, one of the distribution apertures 33 is in communication with the conduit 43 and another one of the distribution apertures 33 is in communication with the distributor pipe 45. Then, the air goes into an inflatable portion of a product from the second distributor pipe 45.

Referring to FIG. 11, the switch 30 is in the position L, one of the distribution apertures 33 is in communication with the conduit 43 and another one of the distribution apertures 33 is in communication with the distributor pipe 44. Then, the air goes into an inflatable portion of a product from the distributor pipe 44.

Figure 9:
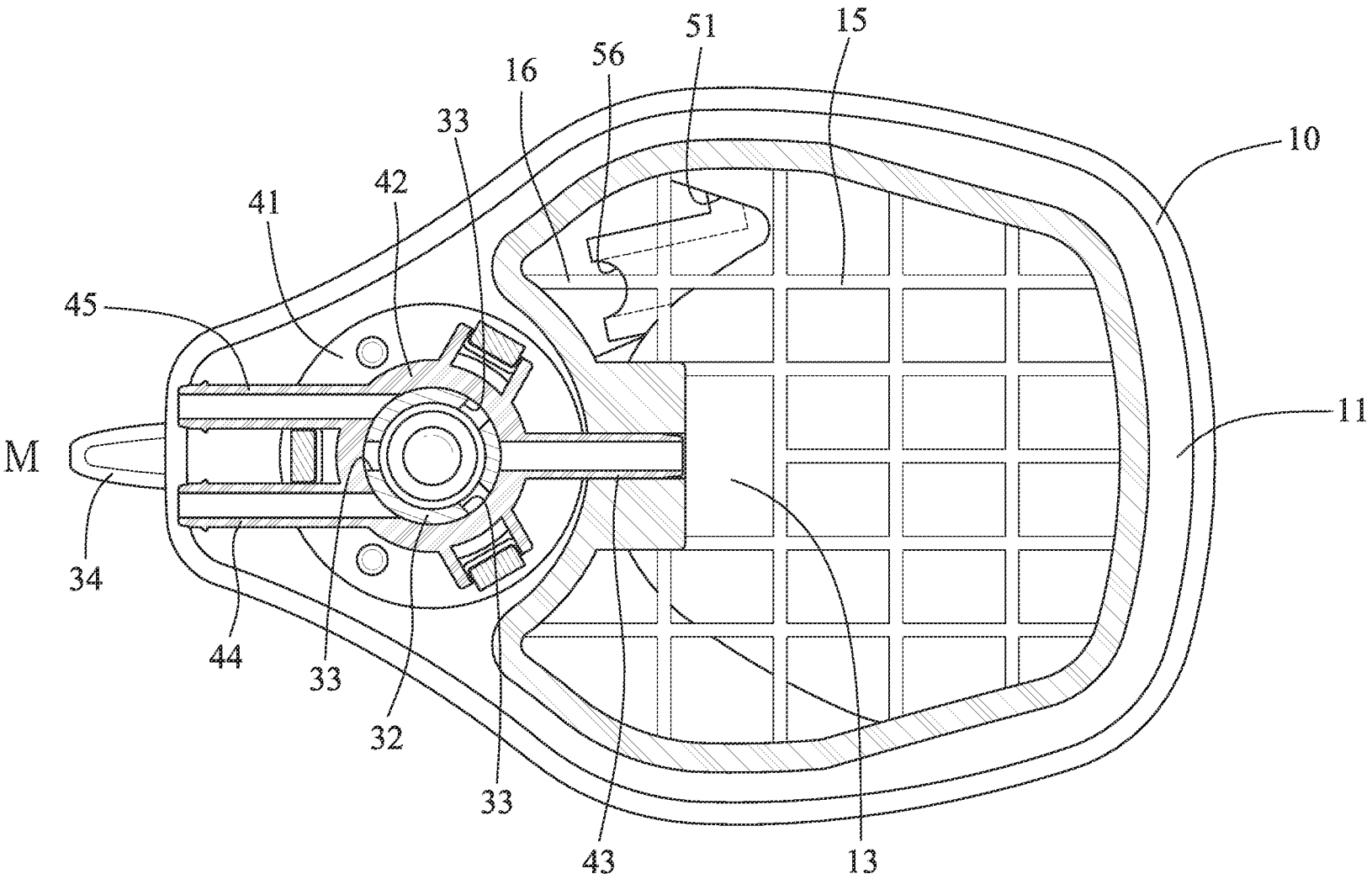
FIG. 9 is another cross-sectional view of the miniature pump shown in FIG. 1.

Referring to FIG. 9, the switch 30 is in the position M. The distribution apertures 33 of the axle 32 are all closed by the periphery of the cylinder 42. The air is not allowed in the miniature pump. Accordingly, the air bag 18 cannot be compressed.

A release unit 70 is located in the knob 31. Referring to FIG. 7, the release unit 70 includes housing 75, a vent 71, a button 72, a valve 73 and a spring 74. The vent 71 is made in the housing 75. The vent 71 is in communication with a space (not numbered) in the axle 32 as the housing 75 is located in the knob 31. The button 72 is movably located in the vent 71. The valve 73 extends from the button 72. The spring 74 is compressed between the button 72 and an internal portion of the housing 75, thereby lifting the button 72 to cause the valve 73 to close the vent 71. The button 72 is pressable to compress the spring 74 move the valve 73 from the vent 71. Thus, air can leave the inflatable portion of the product through the release unit 70 of the miniature pump.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A miniature pump comprising:

an upper shell (10);

an air bag (18) formed on the upper shell (10);

a lower shell (11) connected to the upper shell (10) in an air-tight manner, wherein the lower shell (11) comprises:

a chamber (12) corresponding to the air bag (18), wherein the chamber (12) comprises a floor;

a first grid (15) extending from the floor of the chamber (12);

a second grid (16) extending from the floor of the chamber (12);

a bore (13) in a portion of the chamber (12) not covered by the first and second grids (15, 16);

a channel (14) through which the bore (13) is in communication with exterior of the lower shell (11);

a partition (50) located between the upper and lower shells (10, 11), wherein the partition (50) closes an opening of the air bag (18), wherein the partition (50) is separated from the first and second grids (15, 16), thereby providing a gap (17) between the partition (50) and the first and second grids (15, 16), wherein the partition (50) comprises a cutout (51) corresponding to the second grid (16) and a pothole (52) corresponding to the air bag (18);

a check valve (53) located above the pothole (52), wherein the check valve (53) comprises a passageway (54), an inlet (55) at an end of the passageway (54), an outlet (56) at another end of the passageway (54), wherein the inlet (55) is in communication with the air bag (18), wherein the outlet (56) is aligned to the cutout (51);

a distributor valve (40) located in the lower shell (11), wherein the distributor valve (40) comprises a cylinder (42), a conduit (43) in communication with the cylinder (42) and located in the channel (14), a first distributor pipe (44) in communication with the cylinder (42), and a second distributor pipe (45) in communication with cylinder (42); and a switch (30) comprising an axle (32) pivotably located in the cylinder (42) and distribution apertures (33) in communication with a space in the axle (32), wherein one of the distribution apertures (33) is in communication with the conduit (43) and another one of the distribution apertures (33) is in communication with a selected one of the first and second distributor pipes (44, 45) while the remaining ones of the distribution apertures (33) are closed by the cylinder (42).

2. The miniature pump according to claim 1, wherein the cylinder (42) comprises an annular rib (47), wherein the axle (32) comprises an annular groove (37) for receiving the annular rib (47), thereby keeping the axle (32) of the switch (30) in the cylinder (42) of the distributor valve (40).

3. The miniature pump according to claim 1, further comprising a connector (20) for connecting the upper and lower shells (10, 11) and the distributor valve (40) to one another.

4. The miniature pump according to claim 1, wherein the connector (20) comprises a ring (24) and hooks (25) extending from the ring (24), wherein the ring (24) rests on the upper shell (10) while the hooks (25) extend through the lower shell (11) and hook the distributor valve (40).

5. The miniature pump according to claim 4, wherein the distributor valve (40) comprises a valve housing (41) and receptacles (46) formed in a lower portion of the valve housing (41), wherein the receptacles (46) receive the hooks (25).

6. The miniature pump according to claim 4, wherein the switch (30) comprises a knob (31) located on the ring (24), wherein the ring (24) comprises an arched wall (26), wherein the knob (31) comprises an arched recess (35) for receiving the arched wall (26), wherein the arched recess (35) extends longer than the arched wall (26).

7. The miniature pump according to claim 6, wherein the arched wall (26) comprises a first amount of bosses (27), wherein the arched recess (35) comprises a second amount of dents (36), wherein the second amount is larger than the first amount, wherein a first group of the dents (36) receive the bosses (27) to keep the switch (30) in a first open position where one of the distribution apertures (33) is in communication with the conduit (43) and another one of the distribution apertures (33) is in communication with the first distributor pipe (44), wherein a second group of the dents (36) receive the bosses (27) to keep the switch (30) in a second open position where one of the distribution apertures (33) is in communication with the conduit (43) and another one of the distribution apertures (33) is in communication with the second distributor pipe (45), wherein a third group of the distribution apertures (33) receive the bosses (27) to keep the switch (30) in a closed position where one of the distribution apertures (33) is in communication with the conduit (43) and the remaining ones of the distribution apertures (33) are closed by the cylinder (42).

8. The miniature pump according to claim 6, further comprising a release unit (70) comprising:

a housing (75) inserted in the knob (31);

a vent (71) in the housing (75);

a button (72) movable in the housing (75);

a valve (73) extending from the button (72) via the vent (71), and a spring (74) compressed between the button (72) and an internal portion of the housing (75), thereby biasing the valve (73) to close the vent (71), wherein the button (72) is pressable to move the valve (73) from the vent (71) to release air from the switch (30).

9. The miniature pump according to claim 4, wherein the switch (30) further comprises a lever (34) extending from the knob (31) in a radial manner.

10. The miniature pump according to claim 1, wherein the first grid (15) extends higher than the second grid (16).

* * * * *